US009799470B2

(12) United States Patent
Kipfer

(10) Patent No.: US 9,799,470 B2
(45) Date of Patent: Oct. 24, 2017

(54) EARTHING SWITCH

(71) Applicant: ABB Technology Oy, Helsinki (FI)

(72) Inventor: Manfred Kipfer, Eschenbach (CH)

(73) Assignee: ABB Technology OY (FI)

( * ) Notice: Subject to any disclaimer, the term of this patent is extended or adjusted under 35 U.S.C. 154(b) by 0 days.

(21) Appl. No.: 15/216,013

(22) Filed: Jul. 21, 2016

(65) Prior Publication Data

US 2016/0329176 A1 Nov. 10, 2016

Related U.S. Application Data

(63) Continuation of application No. PCT/EP2015/050258, filed on Jan. 8, 2015.

(30) Foreign Application Priority Data

Jan. 23, 2014 (DE) ..... 20 2014 100 277 U

(51) Int. Cl.
*H01H 31/00* (2006.01)
*H01H 31/28* (2006.01)
(Continued)

(52) U.S. Cl.
CPC ..... *H01H 31/003* (2013.01); *H01H 1/42* (2013.01); *H01H 9/16* (2013.01); *H01H 31/08* (2013.01); *H01H 31/28* (2013.01)

(58) Field of Classification Search
CPC ..... H01H 31/003; H01H 31/08; H01H 31/28; H01H 1/42
(Continued)

(56) References Cited

U.S. PATENT DOCUMENTS 2,009,815 A 7/1935 Powers
2,331,632 A 10/1943 Sauers
(Continued)

FOREIGN PATENT DOCUMENTS

EP 2518750 A1 10/2012

OTHER PUBLICATIONS

European Patent Office, International Search Report & Written Opinion issued in corresponding Application No. PCT/EP2015/050258, dated Mar. 20, 2015, 17 pp.
(Continued)

*Primary Examiner* — Felix O Figueroa
(74) *Attorney, Agent, or Firm* — Taft Stettinius & Hollister LLP

(57) ABSTRACT

An earthing switch is disclosed that includes a base for mounting the earthing switch, a first contact element that is mounted on the base via a first insulating element, a shaft mounted in the base, a second contact element, mounted on the shaft, that can swivel relative to the first contact element, so that the second contact element can move between a closed and an open position, a locking and/or monitoring apparatus for locking the shaft and/or for monitoring the position of the shaft, wherein the locking and/or monitoring apparatus is fitted to the base next to the first contact element, wherein a second insulating element held between the base and the first insulating element has an insulating plate that protrudes from the base and that is arranged between the first contact element and the locking and/or monitoring apparatus.

20 Claims, 3 Drawing Sheets

(51) Int. Cl.
*H01H 9/16* (2006.01)
*H01H 31/08* (2006.01)
*H01H 1/42* (2006.01)

(58) Field of Classification Search
USPC ..... 200/48 KB, 48 A, 48 R, 48 P
See application file for complete search history.

(56) References Cited

U.S. PATENT DOCUMENTS

| | | | | |
|---|---|---|---|---|
| 4,263,487 | A | 4/1981 | Welter et al. | |
| 6,525,274 | B1 * | 2/2003 | Roberts | H01H 31/023 174/138 G |
| 6,713,679 | B2 * | 3/2004 | Roberts | H01H 31/28 174/135 |
| 8,416,541 | B1 * | 4/2013 | White | H01H 31/28 361/2 |
| 8,729,985 | B2 * | 5/2014 | Bullock | H01H 33/6661 335/119 |
| 2012/0300358 | A1 | 11/2012 | Johnson et al. | |

OTHER PUBLICATIONS

German Patent Office, Search Report issued in corresponding Application No. 202014100277.4, dated Oct. 20, 2014, 6 pp.

* cited by examiner

EARTHING SWITCH

FIELD OF THE INVENTION

The invention relates to the field of medium and high voltage technology. It is based on an earthing switch according to the preamble of the independent claim.

BACKGROUND OF THE INVENTION

Earthing switches are used for example in switch cabinets, where the electrical circuits that are under voltage must always be earthed before the door of the switch cabinet is opened.

Such switch cabinets may for example contain components of a converter for an electrical drive. Since the voltages used are ever increasing, it is necessary that the internal electrical insulation of the earthing switches is correspondingly improved with respect to flashovers and creeping currents.

Switches of the type in question are known for example from U.S. Pat. No. 2,331,632, from U.S. Pat. No. 2,009,815 and from U.S. Pat. No. 4,263,487.

SUMMARY OF THE INVENTION

The object of the invention is to provide an earthing switch that has good electrical insulating properties.

This object is achieved by the subject matter of independent claim 1. Further embodiments of the invention are provided by the dependent claims and the description that follows.

The invention relates an earthing switch that can be used for example for voltages of up to 15 kV (approximately 13.8 kV). The earthing switch may for example be arranged in a switch cabinet in such a way that the door of the switch cabinet can only be opened when the earthing switch has been moved into a closed position.

According to one embodiment of the invention, the earthing switch comprises a base for mounting the earthing switch, a first contact element, which is mounted on the base by way of a first insulating element, a shaft mounted in the base, a second contact element, which is mounted on the shaft and can swivel in relation to the first contact element by means of the shaft, so that the second contact element can move between a closed position and an open position, and a locking and/or monitoring device for locking the shaft and/or for monitoring the position of the shaft, which is attached to the base next to the first contact element, wherein a second insulating element is held between the base and the first insulating element and has an insulating plate that protrudes from the base and is arranged between the first contact element and the locking and/or monitoring device.

In other words, the electrical insulation between the first contact element, which is under high voltage, and the locking and/or monitoring device can be improved by the further insulating element, which provides an insulating plate between these two components, so that an already existing insulation by way of an air gap is further improved.

The base may comprise a metal plate, on which the first and/or second insulating element is mounted. The metal plate may comprise side walls, in which the shaft is held in bearings and/or on which the locking and/or monitoring device is mounted. The earthing switch can be connected to earth potential by way of the base.

It should be understood that the first insulating element and the second insulating element are generally two separate components. However, it is also possible that the first insulating element and the second insulating element are provided by one component, though the two insulating elements can be separately distinguished from one another. The first insulating element may for example comprise a body which on one side carries the first electrical contact and on the other side is connected to the second insulating element.

According to one embodiment of the invention, the second insulating element has an elongate portion, which is held between the first insulating element and the base and has first openings for mounting the second insulating element on the base and second openings for mounting the first insulating element on the second insulating element. In other words, the second insulating element may be mounted on the base, for example by means of screws, and the first insulating element may be mounted on the second insulating element, for example by means of screws.

According to one embodiment of the invention, the openings are separated from one another by webs on the elongate portion. The openings may be located on opposite sides of the elongate portion. The webs may extend substantially orthogonally in relation to the opposite sides.

According to one embodiment of the invention, a portion of the second insulating element that protrudes from the elongate portion is configured in the form of a spade, so that the insulating plate is delimited in a U-shaped manner by side walls. When considered from the side, the elongate portion and the insulating plate may run substantially parallel, the insulating plate being connected to the elongate portion for example by way of a sloping surface. The sides of the insulating plate extending away from the first contact element may be connected to side walls that provide stiffening and/or increase the insulation.

According to one embodiment of the invention, the first contact element comprises a contact shoe and the second contact element comprises a contact blade, which are inserted one into the other during the closing of the earthing switch. A contact shoe may in this case comprise one or more spring elements, between which a contact blade can be clamped. A contact blade may be an elongate, flat contact element.

According to one embodiment of the invention, the earthing switch comprises three first contact elements, which are for example arranged in a row on the base, and three second contact elements, which are for example arranged in a row on the shaft. The three first contact elements may for example be connected to a DC link of a converter, for example to its positive, negative and neutral potential. The three second contact elements may be connected in parallel (for example by way of the metallic shaft) and be connected to the earth potential (for example by way of the base).

According to one embodiment of the invention, one of the three second contact elements is provided by an L-shaped component mounted on the shaft and the remaining two second contact elements are provided by a U-shaped component mounted on the shaft. One leg of the L or the legs of the U may in this case provide a contact blade or contact blades.

According to one embodiment of the invention, the locking and/or monitoring device comprises an actuator with a locking pin, mounted on the base, and a locking disk, mounted on the shaft, the locking disk having for fixing the shaft at least one clearance in which the locking pin can engage. With this actuator it can be ensured that the earthing switch remains in a desired open position or closed position.

According to one embodiment of the invention, the actuator comprises a spring, which presses the locking pin in the direction of the locking disk, and/or the actuator of the locking device comprises an energizable coil, which when energized pulls the locking pin away from the locking disk. This coil may for example be activated by a controller when the earthing switch is to be opened or closed and/or is allowed to be opened or closed.

According to one embodiment of the invention, the locking disk has a clearance for fixing the shaft in an open position and/or a clearance for fixing the shaft in a closed position. The locking disk may be a circular disk, which has the clearances in its border. The aforementioned locking pin can engage in the clearances.

According to one embodiment of the invention, the locking and/or monitoring device comprises a plurality of switches, which are mounted on the base and mesh on a camshaft mounted on the shaft, in order to determine a position of the shaft. These switches may be activated and deactivated by a correspondingly formed camshaft (with elevations and/or depressions) when the shaft is at a specific rotational angle.

According to one embodiment of the invention, the switches and the camshaft are configured in such a way that an open position, an intermediate position and a closed position can be detected. It can be ensured in this way that at least these positions can be monitored by an external controller.

According to one embodiment of the invention, the shaft is mounted in the base by bearings (for example sliding bearings). A locking disk and/or a camshaft of the locking and/or monitoring device may be mounted on the shaft in such a way that, with respect to the bearings, it/they is/are arranged outside a portion of the shaft that carries the second contact element. For example, the locking disk and/or the camshaft may be held in a box which is mounted laterally on the base and which may for example also carry the switches.

BRIEF DESCRIPTION OF THE FIGURES

Exemplary embodiments of the invention are described in detail below with reference to the accompanying figures.

The designations used in the figures and their meaning are presented in a summarizing form in the list of designations. In principle, parts that are identical or similar parts are provided with the same designations.

DETAILED DESCRIPTION OF EXEMPLARY EMBODIMENTS

Figure 1:
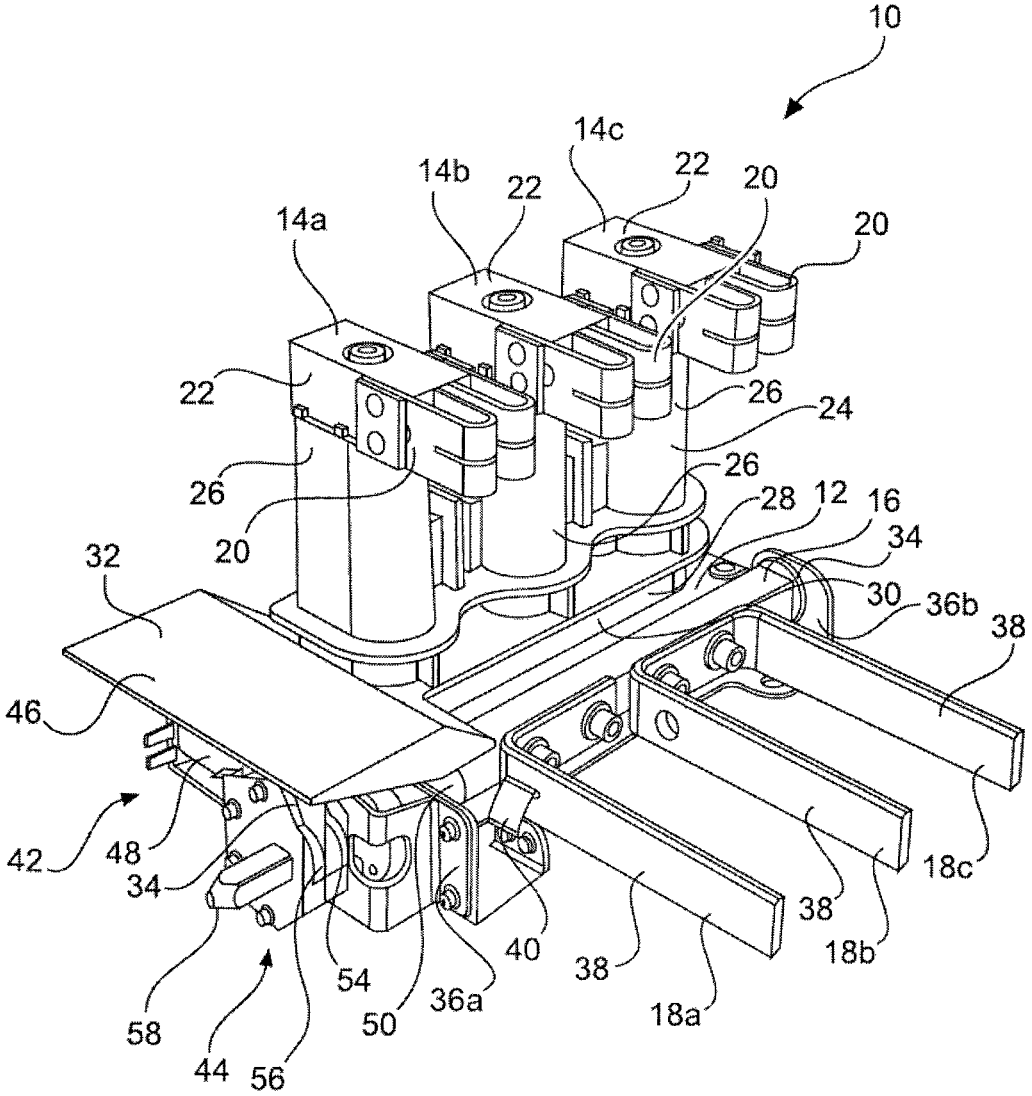
FIG. 1 shows a perspective view of an earthing switch according to one embodiment of the invention.

FIG. 1 shows an earthing switch 10, which comprises a base 12, in which three first contact elements 14*a*, 14*b*, 14*c* are mounted. Additionally mounted on the base 12 is a shaft 16, in which three second contact elements 18*a*, 18*b*, 18*c* are mounted. Turning of the shaft 16 allows the second contact elements 18*a*, 18*b*, 18*c* to be moved between an open position (shown) and a closed position.

The base 12 and/or the shaft 16 may be produced from metal or a conductive material.

Each of the first contact elements 14*a*, 14*b*, 14*c* comprises a contact shoe 20 comprising two springs, which are connected to a contact block 22, which is mounted on a first insulating element 24. For this purpose, the insulating element 24 has for each contact element 14*a*, 14*b*, 14*c* a post 26, which keeps the contact elements 14*a*, 14*b*, 14*c* at a distance from the base 12.

Between the posts 26, the first insulating element 24 may be connected directly to the base 12 and/or to a second insulating element 28.

The second insulating element 28 has an elongate portion 30 and a spade-shaped portion 32. The elongate portion 30 is in this case held between the first insulating element 24 and the base 12. The elongate element extends under the three posts 26 of the first insulating element 24 and then goes over into the spade-shaped portion 32, which extends away from the earthing switch substantially orthogonally in relation to the direction of extent of the posts 26.

The first insulating element 24 and/or the second insulating element 28 are produced from a very poorly conducting material or insulating material, such as for instance plastic or ceramic.

The shaft 16 is mounted in two sliding bearings 34 in side walls 36*a*, 36*b* of the base 12. Between the two bearings, the shaft 16 has a rectangular profile, on which the second contact elements 18*a*, 18*b*, 18*c* are mounted. The first contact element 18*a* is in this case formed as an L-shaped component, one leg providing a contact blade 38. The contact elements 18*b* and 18*c* are provided by a U-shaped component, the legs of which provide two further contact blades 38.

Mounted on the side wall 38*a* and on the base 12 is a securing spring 40, with which the shaft 16 can be kept in the open position. The securing spring 40 thereby engages in a groove in the contact element 18*a*.

Additionally mounted on the side wall 38*a* are a locking device and a monitoring device 44. The spade-shaped portion 32 or its insulating plate 46 spatially separates the locking device 42 and the monitoring device 44 from the contact elements 14*a*, 14*b*, 14*c*, so that an insulating gap is extended by the air between these components.

Figure 3:
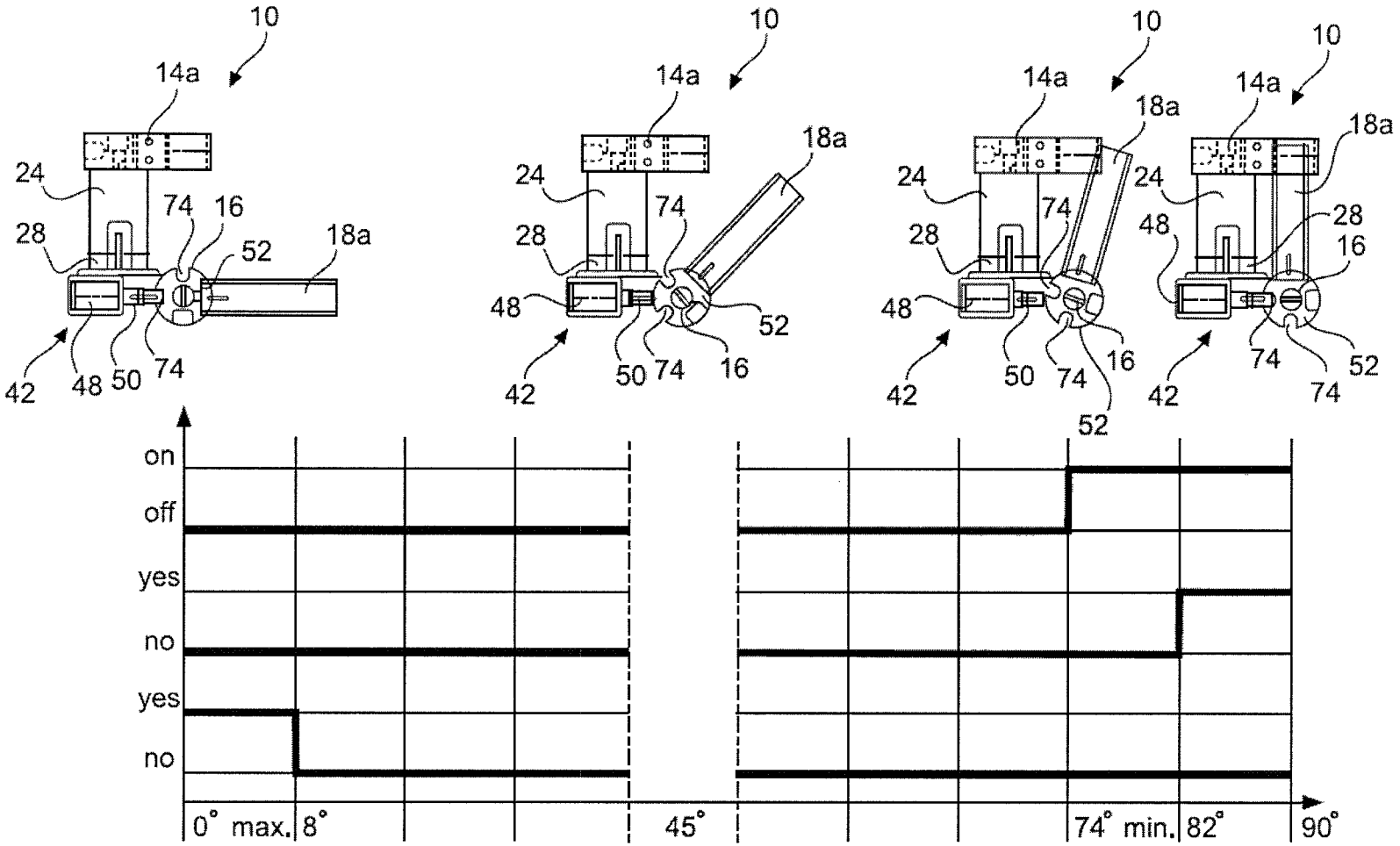
FIG. 3 shows a diagram with switching states of monitoring switches for an earthing switch according to one embodiment of the invention.

The locking device 42 comprises an actuator 48 in the form of an energizable coil, with which a locking disk 52, which is located on the shaft 16, can be prevented from rotation by means of a pin 50 (see FIG. 3).

The monitoring device 44 comprises a plurality of switches 54, which mesh on a camshaft 56 and can thus provide information concerning the position of the second contact elements 18*a*, 18*b*, 18*c*.

At the end that protrudes through the side wall 36*a*, through the locking device 42 and through the monitoring device 44, the shaft 16 has a rectangular rod 58, onto which a key for turning the shaft 16 can be fitted.

The earthing switch 10 can be connected to a ground potential or earthing potential by way of the base 12. The contact elements 16*a*, 16*b*, 16*c* can also be connected to this potential by way of the shaft 16.

The contact elements 14*a*, 14*b*, 14*c* may be understood as the high-voltage region of the earthing switch. The contact elements 14*a*, 14*b*, 14*c* may for example be connected to a power circuit in a switch cabinet, such as for instance the DC link of a converter, which during operation can be at a voltage of up to 15 kV (for example 6.9 kV or 13.8 kV).

For example, the contact element 14*a* may be connected to a negative potential, the contact element 14*b* may be connected to a neutral potential and the contact element 14*c* may be connected to a positive potential of the DC link. By connecting to the contact elements 18*a*, 18*b*, 18*c*, the DC link can then be discharged and set to ground potential.

The contact elements 18*a*, 18*b*, 18*c*, the base 12, the shaft 16, the locking device 42 and the monitoring device 44 may be understood as the low-voltage region of the earthing switch 10. The contact elements 18*a*, 18*b*, 18*c*, the base 12 and the shaft 16 are at ground potential. The locking device 42 and the monitoring device 44 are as a maximum at the potential of a control voltage (for example a maximum of 100 V).

The second insulating element 28 and the insulating plate 46 improve the electrical insulation between the high-voltage region and the low-voltage region.

Figure 2:
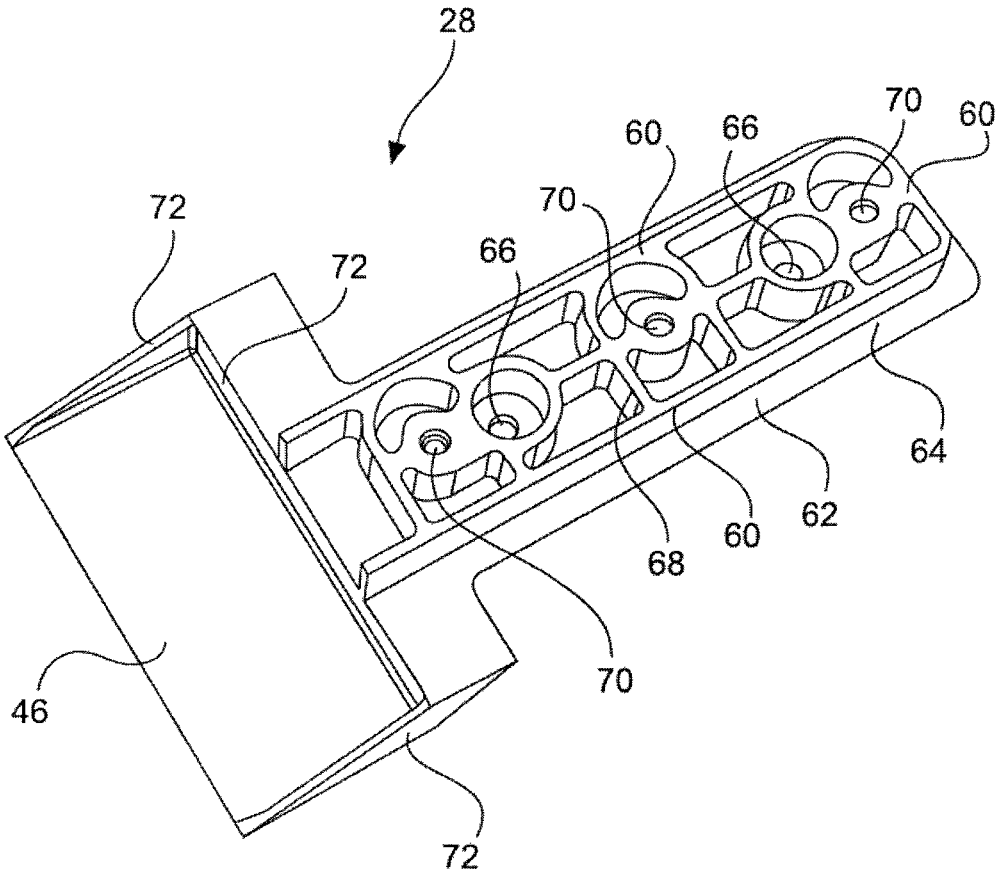
FIG. 2 shows a perspective view of the underside of an insulating element for an earthing switch according to one embodiment of the invention.

FIG. 2 shows a perspective view of the second insulating element 28 obliquely from below.

The elongate portion 30 has a U-shaped side wall 60, which provides a substantially cuboidal basic shape for the elongate portion 30. On the side wall 60 there is a plate 62, which protrudes beyond the side wall 60, and consequently forms a peripheral border 64. In the plate 62 are two openings 66, which serve for mounting the first insulating element 24 on the second insulating element 28. These openings are delimited by webs 68, which (in the same way as the side wall 60) protrude orthogonally from the plate 62. The webs 68 carry three flat portions (parallel to the plate 62), in which there are a further three openings 70, by way of which the second insulating element 28 can be mounted on the base 12. The openings 66, 70 are spaced equally apart and/or lie on one line.

The spade-shaped portion 32 comprises the insulating plate 46, which is connected by way of the orthogonal side wall 72 to the plate 62, which at its end is widened in a T-like manner. The side walls 72 surround the insulating plate 46 in a U-shaped manner.

FIG. 3 shows the earthing switch 10 schematically in an open position, a half-closed position, a contacting position and a closed position (from left to right).

In the closed position and in the open position, the earthing switch 10 is kept in this position by the locking device 42, in that the locking pin 50 engages in a respective clearance 74 in the locking disk 52. The actuator 48 may for example comprise a coil, which when energized pulls the locking pin 50 away from the locking disk 52, and/or comprise a spring, which presses the locking pin in the direction of the locking disk.

With the locking device 42, the earthing switch 10 can only be actuated when the actuator 48 (or its coil) has been energized.

In the diagram, the switching state of the earthing switch 10 and of the switches 54 of the monitoring device 44 can be read off under the various positions. The shaft 16 can move in an angular range from 0° to 90°.

Between 0° (completely open position) and 74° (contacting position), the earthing switch 10 is open ("off") and after that closed up to 90° (completely closed position) ("on").

The cam disk 56 is designed in such a way that one or more first switches 54 between 0° and a minimum of 82° are switched off ("no") and after that are switched on ("yes"). One or more second switches 54 are switched on between 0° and a maximum of 8° ("yes") and after that are switched off ("no").

For example, the coil can only be energized by way of a controller when the controller detects that at least one of the switches 54 is switched on ("yes").

It should additionally be pointed out that "comprising" does not exclude other elements or steps and "one" or "a(n)" does not exclude more than one. Furthermore, it should be pointed out that features or steps that have been described by reference to one of the exemplary embodiments above can also be used in combination with other features or steps of other exemplary embodiments described above. Designations in the claims should not be regarded as restrictive.

LIST OF DESIGNATIONS

10 Earthing switch
12 Base
14*a*, 14*b*, 14*c* First contact element
16 Shaft
18*a*, 18*b*, 18*c* Second contact element
20 Contact shoe
22 Contact block
24 First insulating element
26 Post
28 Second insulating element
30 Elongate portion
22 Spade-shaped portion
34 Sliding bearing
36*a*, 36*b* Side wall of the base
38 Contact blade
40 Securing spring
42 Locking device
44 Monitoring device
46 Insulating plate
28 Actuator
50 Locking pin
52 Locking disk
54 Switch
56 Camshaft
58 Rod for key
60 Side wall
62 Plate
64 Border
66 Opening
68 Web
70 Opening
72 Side wall
74 Clearance

The invention claimed is:

1. An earthing switch, comprising:

a base for mounting the earthing switch;

a first contact element, which is mounted on the base by way of a first insulating element;

a shaft mounted in the base;

a second contact element, which is mounted on the shaft and can swivel in relation to the first contact element by virtue of being mounted to the shaft, so that the second contact element can move between a closed position and an open position; and at least one of a locking and monitoring device wherein the locking device is used for locking the shaft and the monitoring device is used for monitoring the position of the shaft, the at least one of the locking and monitoring device being attached to the base next to the first contact element;

wherein a second insulating element is held between the base and the first insulating element and has an insulating plate that protrudes from the base and is arranged between the first contact element and the at least one of the locking and monitoring device.

2. The earthing switch according to claim 1, wherein the second insulating element has an elongate portion, which is held between the first insulating element and the base and has first openings for mounting the second insulating element on the base and second openings for mounting the first insulating element on the second insulating element.

3. The earthing switch according to claim 2, wherein the openings are separated from one another by webs the elongate portion.

4. The earthing switch according to claim 1, wherein a portion of the second insulating element that protrudes from the elongate portion is configured in the form of a spade, so that the insulating plate is delimited in a U-shaped manner by side walls.

5. The earthing switch according to claim 1, wherein the first contact element comprises a contact shoe and the second contact element comprises a contact blade, which are inserted one into the other during the closing of the earthing switch.

6. The earthing switch according to claim 1, wherein the earthing switch comprises three first contact elements, which are arranged in a row on the base, and three second contact elements, which are arranged in a row on the shaft; and wherein one of the three second contact elements is provided by an L-shaped component mounted on the shaft and the remaining two second contact elements are provided by a U-shaped component mounted on the shaft.

7. The earthing switch according to claim 1, wherein the at least one of the locking and monitoring device comprises an actuator with a locking pin, mounted on the base, and a locking disk, mounted on the shaft, the locking disk having for fixing the shaft at least one clearance in which the locking can engage; and wherein the at least one of the locking and monitoring device comprises a plurality of switches, which are mounted on the base and mesh on a camshaft mounted on the shaft, in order to determine a position of the shaft.

8. The earthing switch according to claim 7, wherein the actuator comprises a spring, which presses the locking pin in the direction of the locking disk, and the actuator comprises an energizable coil, which when energized pulls the locking pin away from the locking; and wherein the locking disk has a clearance for fixing the shaft to provide at least one of an open position and a clearance for fixing the shaft in a closed position.

9. The earthing switch according to claim 7, wherein the switches and the camshaft are configured in such a way that an open position, an intermediate position and a closed position can be detected.

10. The earthing switch according to claim 1, wherein the shaft is mounted in the base by sliding bearings;

wherein at least one of a locking disk and camshaft of the at least one of the locking and monitoring device device is/are mounted on the shaft in such a way that, with respect to the sliding bearings, to be arranged outside a portion of the shaft that carries the second contact element.

11. The earthing switch according to claim 1, wherein the earthing switch comprises three first contact elements, which are arranged in a row on the base, and three second contact elements, which are arranged in a row on the shaft.

12. The earthing switch according to claim 1, wherein one of the three second contact elements is provided by an L-shaped component mounted on the shaft and the remaining two second contact elements are provided by a U-shaped component mounted on the shaft.

13. The earthing switch according to claim 1, wherein the at least one of the locking and monitoring device comprises an actuator with a locking pin, mounted on the base, and a locking disk, mounted on the shaft, the locking disk having for fixing the shaft at least one clearance in which the locking can engage.

14. The earthing switch according to claim 1, wherein the at least one of the locking and monitoring device comprises a plurality of switches, which are mounted on the base and mesh on a camshaft mounted on the shaft, in order to determine a position of the shaft.

15. The earthing switch according to claim 7, wherein the actuator comprises a spring, which presses the locking pin in the direction of the locking disk, and the actuator comprises an energizable coil, which when energized pulls the locking pin away from the locking.

16. The earthing switch according to claim 7, wherein the locking disk has a clearance for fixing the shaft to provide at least one of an open position and a clearance for fixing the shaft in a closed position.

17. The earthing switch according to claim 13, wherein the switches and the camshaft are configured in such a way that an open position, an intermediate position and a closed position can be detected.

18. The earthing switch according to claim 14, wherein the switches and the camshaft are configured in such a way that an open position, an intermediate position and a closed position can be detected.

19. The earthing switch according to claim 15, wherein the switches and the camshaft are configured in such a way that an open position, an intermediate position and a closed position can be detected.

20. The earthing switch according to claim 16, wherein the switches and the camshaft are configured in such a way that an open position, an intermediate position and a closed position can be detected.

* * * * *